US010196237B2

(12) United States Patent
Kattainen et al.

(10) Patent No.: US 10,196,237 B2
(45) Date of Patent: Feb. 5, 2019

(54) METHOD FOR PERFORMING AN EMERGENCY STOP USING A DECLARATION PROFILE OF AN ELECTRIC MOTOR

(71) Applicant: KONE Corporation, Helsinki (FI)

(72) Inventors: Ari Kattainen, Hyvinkää (FI); Antti Hovi, Hyvinkää (FI); Petteri Kangas, Hyvinkää (FI); Lauri Stolt, Helsinki (FI)

(73) Assignee: KONE CORPORATION, Helsinki (FI)

( * ) Notice: Subject to any disclaimer, the term of this patent is extended or adjusted under 35 U.S.C. 154(b) by 415 days.

(21) Appl. No.: 15/051,277

(22) Filed: Feb. 23, 2016

(65) Prior Publication Data

US 2016/0167921 A1 Jun. 16, 2016

Related U.S. Application Data

(63) Continuation of application No. PCT/FI2014/050683, filed on Sep. 8, 2014.

(30) Foreign Application Priority Data

Sep. 10, 2013 (FI) ..... 20135913

(51) Int. Cl.

| | |
|---|---|
| ***B66B 1/32*** | (2006.01) |
| ***B66B 5/02*** | (2006.01) |
| ***B66B 1/24*** | (2006.01) |
| ***B66B 1/30*** | (2006.01) |
| ***B66B 5/00*** | (2006.01) |
| ***B66B 5/04*** | (2006.01) |

(52) U.S. Cl.

CPC ..... *B66B 5/02* (2013.01); *B66B 1/24* (2013.01); *B66B 1/30* (2013.01); *B66B 1/32* (2013.01); *B66B 5/0031* (2013.01); *B66B 5/04* (2013.01)

(58) Field of Classification Search

CPC .... B66B 5/02; B66B 1/24; B66B 1/30; B66B 1/32; B66B 5/0031; B66B 5/04

USPC ..... 187/247, 277, 288, 289, 293, 296, 297, 187/391, 393

See application file for complete search history.

(56) References Cited

U.S. PATENT DOCUMENTS

| | | | | |
|---|---|---|---|---|
| 5,893,432 | A | 4/1999 | Nguyen et al. | |
| 5,969,303 | A | 10/1999 | Piserchia et al. | |
| 6,802,395 | B1 * | 10/2004 | Helstrom | B66B 5/02 187/247 |
| 7,533,763 | B2 * | 5/2009 | Kattainen | B66B 1/28 187/287 |
| 7,575,100 | B2 * | 8/2009 | Kugiya | B66B 5/06 187/293 |

(Continued)

FOREIGN PATENT DOCUMENTS

| | | | |
|---|---|---|---|
| JP | 6-1548 | A | 1/1994 |
| JP | 2006-315823 | A | 11/2006 |
| WO | WO 2011/086230 | A1 | 7/2011 |

*Primary Examiner* — Anthony Salata

(74) *Attorney, Agent, or Firm* — Birch, Stewart, Kolasch & Birch, LLP

(57) ABSTRACT

A method for performing an emergency stop with an elevator and a safety arrangement of an elevator. In the method, when an emergency stop criterion is fulfilled, the elevator car is driven with the electric motor of the hoisting machine to a stop with a given deceleration profile.

20 Claims, 3 Drawing Sheets

(56) References Cited

U.S. PATENT DOCUMENTS

| | | | | |
|---|---|---|---|---|
| 7,921,969 | B2 * | 4/2011 | Stolt | B66B 1/30 187/293 |
| 8,177,034 | B2 * | 5/2012 | Ueda | B66B 5/0062 187/293 |
| 8,207,700 | B2 * | 6/2012 | Syrman | H02P 3/26 187/288 |
| 8,235,180 | B2 * | 8/2012 | Kattainen | B66B 1/32 187/288 |
| 8,408,364 | B2 * | 4/2013 | Kangas | B66B 1/3492 187/393 |
| 8,439,168 | B2 * | 5/2013 | Kondo | B66B 1/285 187/288 |
| 8,869,945 | B2 * | 10/2014 | Harkonen | B66B 1/28 187/288 |
| 9,022,178 | B2 * | 5/2015 | Foschini | B66B 1/302 187/293 |
| 2010/0038185 | A1 | 2/2010 | Kattainen et al. | |
| 2012/0073909 | A1 * | 3/2012 | Kondo | B66B 1/32 187/247 |
| 2016/0145074 | A1 * | 5/2016 | Kattainen | B66B 5/022 187/254 |

* cited by examiner

Legend

1 - elevator car
2 - hoisting machine
4 - machinery brakes
5 - traction sheave
6 - safety controller
7a, 7b - safety contacts
8 - hoisting roping
9 - frequency converter
10 - counterweight
12 - elevator hoistway
13 - data transfer bus
14 - door zone sensor
15 - acceleration sensor
16- safety signal
17 - contactors
18 - brake control circuit
23 - electricity network

METHOD FOR PERFORMING AN EMERGENCY STOP USING A DECLARATION PROFILE OF AN ELECTRIC MOTOR

CROSS REFERENCE TO RELATED APPLICATIONS

This application is a Continuation of PCT International Application No. PCT/FI2014/050683, filed on Sep. 8, 2014, which claims priority under 35 U.S.C. 119(a) to Patent Application No. 20135913, filed in Finland on Sep. 10, 2013, all of which are hereby expressly incorporated by reference into the present application.

FIELD OF THE INVENTION

The invention relates to solutions for performing an emergency stop with an elevator.

BACKGROUND OF THE INVENTION

In an emergency stop situation of an elevator the elevator car is stopped by disconnecting the supply of electric power to the electric motor of the hoisting machine of the elevator, as well as simultaneously connecting machinery brakes, of which there are usually two, to brake the traction sheave of the hoisting machine.

Different elevators can be counterweighted for different loads. The load of the elevator also varies from one run to another. Consequently, during an emergency stop the imbalance of forces varies. It follows from the variation in the imbalance of forces that during an emergency stop also the deceleration of the elevator car varies, in which case an emergency stop can, depending on the situation, result in either excessive or insufficient deceleration of the elevator car.

AIM OF THE INVENTION

One aim of the invention is to disclose a solution by means of which the deceleration during an emergency stop can be kept within the desired limits despite variation in the balancing of the elevator and variation in the load of the elevator. To achieve this aim the invention discloses a method according to claim 1 and also a safety arrangement according to claim 10.

One aim of the invention is to prevent reduction of the friction between the hoisting roping and the traction sheave during an emergency stop. To achieve this aim the invention discloses a method according to claim 8.

One aim of the invention is to adapt an emergency stop to the operating state of the safety system of an elevator. To achieve this aim the invention discloses a method according to claim 7 and also a safety arrangement according to claim 17.

The preferred embodiments of the invention are described in the dependent claims. Some inventive embodiments and inventive combinations of the various embodiments are also presented in the descriptive section and in the drawings of the present application.

SUMMARY OF THE INVENTION

Method for performing an emergency stop with an elevator, in which method when an emergency stop criterion is fulfilled, the elevator car is driven with the electric motor of the hoisting machine to a stop with a given deceleration profile.

According to a second aspect, the safety arrangement of an elevator comprises an elevator car, hoisting roping of the elevator car and also a hoisting machine, comprising an electric motor and also a traction sheave, via which the aforementioned hoisting roping of the elevator car travels. The safety arrangement also comprises a controller, which is configured to regulate the movement of the elevator car by supplying current to the electric motor of the hoisting machine, and also a monitoring unit, which is configured to determine the operating state of the elevator and also to compare the determined operating state to one or more emergency stop criteria. The monitoring unit is configured when one or more emergency stop criteria are fulfilled, to form an emergency stop command for the controller. The controller comprises a processor for forming a deceleration profile. The controller is configured to drive the elevator car with the electric motor of the hoisting machine to a stop with a deceleration profile to be formed in response to an emergency stop command.

The machinery brakes of the hoisting machine are, when an emergency stop starts, conventionally connected to brake the traction sheave. Engagement of the brakes might cause unnecessarily large deceleration, which feels unpleasant to the passengers and in the worst case might cause slight injury. Particularly in elevators without a counterweight as well as in elevators having, e.g. for energy-saving reasons, a counterweight that is lighter than normal, the difference between the smallest and greatest deceleration during an emergency stop can be unnecessarily large when braking with the machinery brakes.

The solution presented in the description brings an improvement to this because during an emergency stop the deceleration always remains according to the deceleration profile regardless of the balancing, load and drive direction of the elevator.

In some embodiments the machinery brake is connected to brake the traction sheave of the hoisting machine of the elevator at the same time as the elevator car is driven with the electric motor of the hoisting machine to a stop. This means that only one of the machinery brakes is connected to brake the traction sheave of the hoisting machine. In this case the braking can be performed using simultaneously for braking both a machinery brake and also the motor braking of the electric motor of the hoisting machine. Also the adjustment need/tolerance requirements of the braking torque of the machinery brake decrease because variation of the braking force of the machinery brake can be compensated with the electric motor of the hoisting machine. The braking force can vary e.g. owing to ambient conditions; in addition, there can be a unit-specific difference between different brakes. Consequently, if a machinery brake does not brake sufficiently, then braking is performed also with the electric motor of the hoisting machine. If the braking force of the machinery brake, and consequently the deceleration of the traction sheave, is excessive, on the other hand, the electric motor drives against the brake in such a way that the deceleration remains according to the given deceleration profile. By means of the solution a unit-specific variation in braking force between different brakes that is larger than before can be permitted, in which case the structure of the brakes can be simplified. At the same time the reliability of the brakes improves and also costs decrease.

In some embodiments the movement of the elevator car is measured during an emergency stop and a machinery brake is connected to brake the traction sheave of the hoisting machine of the elevator at the same time as the elevator car is driven with the electric motor of the hoisting machine to a stop, if the deceleration of the elevator car during the emergency stop falls below the threshold value. In this case the braking can be performed using simultaneously for braking both a machinery brake and also the motor braking of the electric motor of the hoisting machine. This solution is advantageous particularly when the deceleration needed is so great that the braking force of the electric motor of the hoisting machine might otherwise end prematurely.

In some embodiments a threshold value for limiting the permitted movement of the elevator car is determined and in addition a second machinery brake is connected to brake the traction sheave of the hoisting machine of the elevator and the power supply to the electric motor of the hoisting machine of the elevator is disconnected, if a movement of the elevator car during an emergency stop differs from the permitted movement according to the threshold value by more than the threshold value.

In some embodiments, when the speed of the elevator car during an emergency stop falls below the threshold value, a machinery brake is connected and also the power supply to the electric motor of the hoisting machine of the elevator is disconnected. This means that the elevator is brought into a safe state in the ending phase of the emergency stop.

In some embodiments at least two deceleration profiles with different maximum decelerations are formed. In some embodiments the deceleration profile to be used is selected from the aforementioned at least two deceleration profiles on the basis of the state of the safety circuit of the elevator. In this way a smaller deceleration can be used in situations in which the safety circuit of the elevator detects a functional nonconformance that requires an emergency stop but is not particularly critical. This type of situation is e.g. an emergency stop to be performed in the middle of the elevator hoistway, in which on the basis of the state of the safety circuit there is sufficient deceleration distance for a reduced deceleration. Furthermore, a greater deceleration can be used in critical situations that require particularly fast emergency braking. This type of situation is e.g. an emergency stop to be performed in the proximity of the end zone of the elevator hoistway or in another situation in which the deceleration distance is essentially limited.

In some embodiments the slipping on the traction sheave of the hoisting roping of the elevator car is monitored during an emergency stop, and if the magnitude of the slipping exceeds the threshold value, the deceleration of the elevator car in the deceleration profile is reduced. This means that when it is detected that the hoisting roping is starting to slip on the traction sheave the braking force of the hoisting machine/deceleration of the traction sheave is reduced in such a way that the slipping ceases and static friction between the hoisting roping and the traction sheave is again obtained, said static friction being greater than the kinetic friction during slipping.

In some embodiments one or more of the following serves as an emergency stop criterion: an electricity outage, opening of a safety contact of the elevator, overspeed of the elevator car, excessive acceleration or deceleration of the elevator car.

In some embodiments the speed and the deceleration of the elevator car are monitored during an emergency stop. If the speed or deceleration of the elevator car differs from the deceleration profile by more than the given threshold value, at least two machinery brakes are connected to brake the traction sheave and also the electricity supply to the electric motor of the hoisting machine is disconnected. Consequently, if an emergency stop with the electric motor does not progress in the desired manner, the emergency stop is continued to the end by means of the machinery brakes without the electric motor.

MORE DETAILED DESCRIPTION OF PREFERRED EMBODIMENTS OF THE INVENTION

Figure 1:
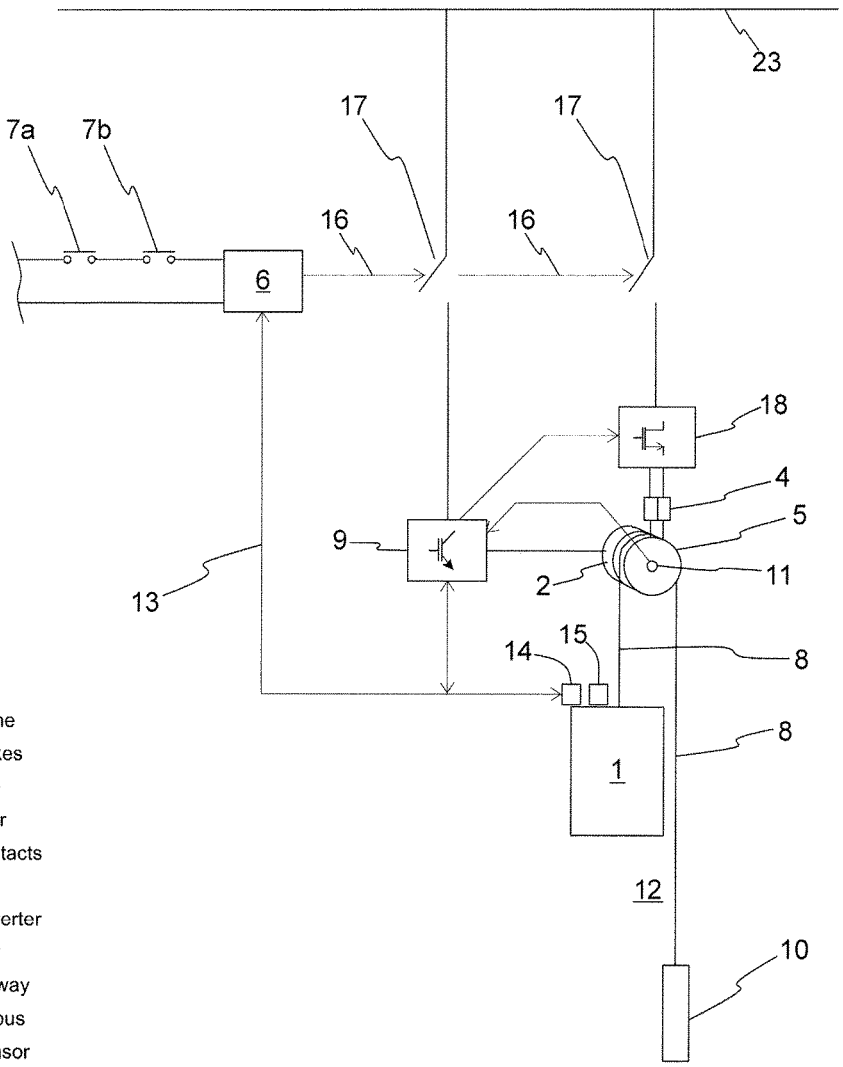
FIG. 1 presents as a block diagram a safety arrangement of an elevator according to an embodiment of the invention.
Figure 2:
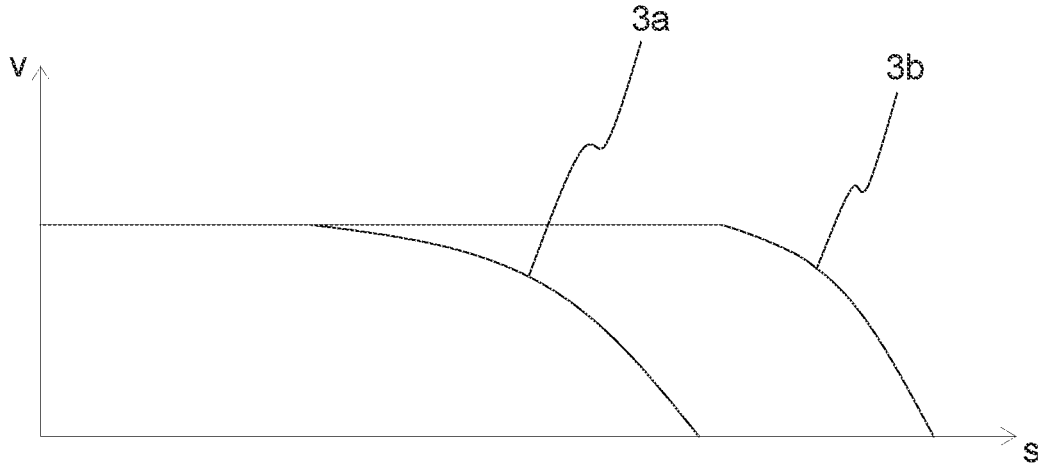
FIG. 2 presents two different emergency stop profiles in the safety arrangement of FIG. 1.
Figure 3:
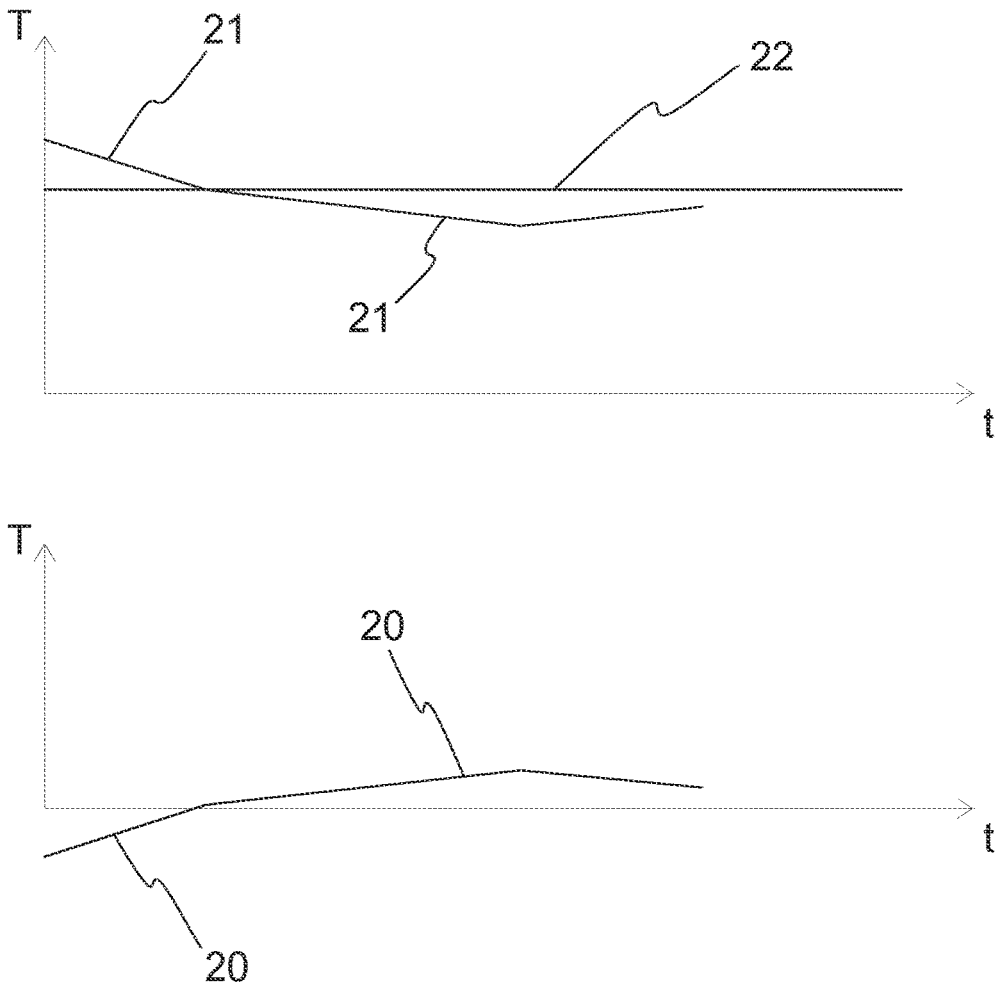
FIG. 3 illustrates the torque of a machinery brake as well as of an electric motor of a hoisting machine during an emergency stop.

For the sake of clarity, FIGS. 1-3 endeavor to present only the features that are essential from the viewpoint of understanding the invention. Consequently e.g. some generally known parts belonging to an elevator are not necessarily presented in the figures if the presentation of them is not significant from the viewpoint of understanding the invention.

FIG. 1 presents a safety arrangement in an elevator, in which the elevator car 1 is moved in the elevator hoistway 12 by pulling the hoisting roping 8 of the elevator car with the traction sheave 5 of the hoisting machine 2. The elevator car 1 is driven by rotating the traction sheave 5 with an electric motor in the hoisting machine 2, by supplying current to the electric motor from the electricity network 23 with a frequency converter 9. The elevator car 1 is also braked by the electric motor of the hoisting machine 2 with motor braking, in which case electric power returns to the frequency converter 9, from where it is supplied onwards back into the electricity network 23. The electric motor can be e.g. a permanent-magnet synchronous motor, an induction motor or a reluctance motor, or otherwise also a direct-current motor. In the elevator of FIG. 1, the counterweight 10 is dimensioned to be more lightweight than usual, for energy-saving reasons. The weight of the counterweight can be selected for the specific elevator e.g. in such a way that the elevator is in balance, i.e. the rope force in the hoisting roping 8 is equal on both sides of the traction sheave 5, when approx. 20-40 percent, depending on the case, of the permitted maximum load has been loaded into the elevator car.

A microprocessor is fitted into connection with the frequency converter 9, which microprocessor calculates the speed reference of the elevator car, i.e. the target value for the speed of the elevator car 1. The frequency converter 9 measures the speed of rotation of the traction sheave 5 with a pulse encoder 11 and adjusts the speed of the traction sheave 5, and thereby of the elevator car 1, towards the speed reference by adjusting the current of the electric motor of the hoisting machine 2.

The hoisting machine also comprises two electromagnet machinery brakes 4. The machinery brakes 4 are kept open by supplying electric power with the brake control circuit 18 to the electromagnets of the machinery brakes 4, and the machinery brakes 4 are connected to mechanically brake the traction sheave 5 of the hoisting machine by disconnecting the electricity supply to the electromagnets of the machinery brakes 4. If an emergency stop of the elevator car 1 were to be performed by connecting both machinery brakes 4 when the elevator car was moving, the deceleration of the elevator car 1 might, depending on the situation (i.e. depending on the load, location, drive direction and speed of the elevator car), be excessive. Excessive deceleration feels unpleasant to the passengers and in the worst case might cause slight injury. For this reason, among others, in the safety arrangement for an elevator according to FIG. 1 an emergency stop is implemented in the manner described hereinafter.

The safety arrangement of FIG. 1 comprises positive-opening safety contacts 7*a*, 7*b*, which are situated to monitor the safety of selected points in the elevator. With the safety contacts 7*a*, 7*b* e.g. the position/locking of the doors of the elevator hoistway 12 are monitored, as are also e.g. the extreme limits of permitted movement of the elevator car 1 in the elevator hoistway 12, the operation of the overspeed governor of the elevator, the position of the car door of the elevator, the state of the end buffers of the elevator hoistway, temporary service spaces to be formed in the elevator hoistway, the state of the safety machinery to be activated with the overspeed governor, et cetera. The opening of a safety contact indicates endangerment of the safety of a monitored point.

The safety arrangement also comprises an electronic safety controller 6. The safety contacts 7*a*, 7*b* of the elevator are conducted to the electronic safety controller 6, and the electronic safety controller 6 is configured to read the state of the safety contacts 7*a*, 7*b*. Between the safety controller 6 and the frequency converter 9 is a data transfer bus 13, via which the safety controller 6 at regular intervals receives from the frequency converter 9 information about the speed of the traction sheave 5 of the hoisting machine. The data transfer bus 13 is taken via a traveling cable onwards to the elevator car 1, and the safety controller 6 receives via the data transfer bus 13 measuring data from the acceleration sensor 15 of the elevator car 1 as well as from the door zone sensor 14, which measuring data indicates the position of the elevator car 1 at the point of a hoistway door in the elevator hoistway 12 as well as information about which floor the elevator car 1 is situated at.

The safety controller 6 also comprises undervoltage monitoring of the electricity network 23, by means of which the safety controller 6 receives information about an electricity outage that has occurred in the electricity network 23.

The safety controller 6 comprises a relay output for a safety signal 16. If necessary, the safety controller 6 brings the elevator to a safe state by disconnecting the aforementioned safety signal 16 by opening the contacts of a safety relay that is in the safety controller 6. When the safety signal 16 is disconnected, the machinery brakes 4 engage to brake the traction sheave 5 of the hoisting machine and the current supply to the electric motor of the hoisting machine 2 ceases. The safety controller 6 as well as the aforementioned monitoring circuits, disconnection circuits and measuring circuits to be connected to the safety controller 6, together form the safety circuit of the elevator.

The safety controller 6 compares the information read from the safety contacts 7*a*, 7*b* as well as the undervoltage monitoring information, the speed information of the traction sheave 5 of the hoisting machine, the measuring information of the acceleration sensor 15 and the information read from the door zone sensor 14 to the emergency stop criteria that are stored in the memory of the safety controller 6. When one or more emergency stop criteria are fulfilled, the safety controller 6 forms an emergency stop command, and also sends the emergency stop command to the frequency converter 9 via the data transfer bus 13.

The various functional deviations detected by the safety circuit have their own emergency stop criteria. How critical the emergency stop situation is depends on the emergency stop criterion, and the safety controller 9 includes in the emergency stop command to be formed information about the fulfilling of which emergency stop criterion is in question at that particular time.

After it has received the emergency stop command, the frequency converter 9 immediately starts an emergency stop. The frequency converter 9 performs an emergency stop by driving the elevator car 1 with the electric motor of the hoisting machine 2 to a stop with a given deceleration profile. It must be noted that the safety controller 6 does not disconnect the safety signal 16 in connection with an emergency stop, in which case an emergency stop with the torque of the electric motor is possible. The solution of the description means that during an emergency stop the deceleration always remains as that desired regardless of the balancing, load and drive direction of the elevator.

The frequency converter 9 selects the deceleration to be used from at least two different alternatives on the basis of the emergency stop criterion. FIG. 2 presents two optional deceleration profiles 3*a*, 3*b*. In the deceleration profile 3*a* of lesser deceleration the maximum deceleration is most preferably approx.

$$1.0\frac{m}{s^2} - 1.2\frac{m}{s^2},$$

and in the deceleration profile 3*b* of greater deceleration the maximum deceleration is most preferably approx.

$$1.5\frac{m}{s^2} - 2.0\frac{m}{s^2}.$$

The frequency converter 9 uses the deceleration profile 3*a* of smaller deceleration in situations in which a functional nonconformance according to an emergency stop criterion requires an emergency stop but is not particularly critical. This type of situation is e.g. an emergency stop to be performed in the middle of the elevator hoistway, in which on the basis of information received from a safety contact 7*a*, 7*b* and also from a door zone sensor 14 there is sufficient deceleration distance for a reduced deceleration. The frequency converter 9 uses the deceleration profile 3*b* of greater deceleration in critical situations in which a functional nonconformance according to an emergency stop criterion requires particularly fast emergency braking. This type of situation is e.g. emergency braking to be performed in the proximity of an end zone of the elevator hoistway 12 or in another situation in which the deceleration distance is, on the basis of information received from a safety contact 7*a*, 7*b* and also from a door zone sensor 14, essentially limited. There can also be a number of deceleration profiles with different maximum decelerations.

Calculation of a deceleration profile 3*a*, 3*b* can take place with the same microprocessor as calculation of the speed reference; in one further developed embodiment the frequency converter 9 comprises a separate microprocessor for calculating a deceleration profile 3*a*, 3*b*, in which case the emergency stop to be performed with the deceleration profile 3*a*, 3*b* is possible also when the processor calculating the speed reference fails.

The brake control circuit 18 is also configured to supply, under the control of frequency converter 9, current to the electromagnets of the machinery brakes 4 in such a way that the machinery brakes can open and connect independently of each other one at a time.

During an emergency stop the frequency converter 9 measures the speed of rotation of the traction sheave 5 with an encoder 11 and tries to adjust the measured speed to be according to the deceleration profile 3*a*, 3*b* by adjusting the current of the electric motor of the hoisting machine 2. If the deceleration of the traction sheave 5 in this case is not sufficient within the scope of the permitted range of variation (the torque of the electric motor ends prematurely), the frequency converter 9 connects also the second machinery brake 4 to brake the traction sheave 5 at the same time as the frequency converter 9 continues speed regulation of the traction sheave with the electric motor. This situation is presented in more detail in FIG. 3. In the emergency stop of FIG. 3, the frequency converter 9 simultaneously uses for braking in an emergency stop both one of the machinery brakes 4 and also the motor braking of the electric motor of the hoisting machine 2. If the braking torque 21 of the machinery brake 4 is momentarily smaller than the total torque 22 needed (machinery brake does not brake sufficiently) then the frequency converter 9 additionally brakes with the torque 20 of the electric motor of the hoisting machine 2, If, on the other hand, the braking torque 21 exerted by the machinery brake 4, and consequently the deceleration of the traction sheave 5, is momentarily excessive, the frequency converter 9 drives with the electric motor against the brake 4 with a torque 20 in the opposite direction in such a way that the total torque 22, and consequently the deceleration of the traction sheave 5/elevator car 1 remains according to the deceleration profile 3*a*, 3*b*. This means, therefore, that variation of the braking force of a machinery brake 4 is compensated with the electric motor of the hoisting machine 2, in which case a deceleration profile 3*a*, 3*b* for implementing the total torque 22 needed is achieved.

The combined use of the electric motor and the machinery brake 4 in emergency braking described above is advantageous particularly when the deceleration needed in the deceleration profile 3*a*, 3*b* is so great that just the braking force of the electric motor of the hoisting machine might otherwise end prematurely.

By means of the solution a larger, unit-specific variation of braking force between different brakes 4 can also be permitted, in which case the need for manual adjustment of a brake 4 is eliminated and the structure of the brake 4 can be simplified.

The frequency converter 9 also monitors the slipping of the hoisting roping 8 on the traction sheave 5 during an emergency stop. The frequency converter 9 compares the measuring information being received from the acceleration sensor 15 to the measuring information of the traction sheave 5 being received from the encoder 11, and if the measuring data differ from each other by more than what is permitted, the frequency converter deduces that the grip has weakened and that the hoisting roping 8 has started to slip on the traction sheave 5. Since the friction of the hoisting roping 8 on the traction sheave 5 decreases during slipping, the frequency converter 9 momentarily reduces the deceleration in the deceleration profile 3*a*, 3*b* in such a way that the slipping ceases and the friction returns to the original level.

The safety controller 6 monitors the speed and the deceleration of the elevator car I during an emergency stop. Threshold values for the permitted speed and deceleration of the elevator car are recorded in the memory of the safety controller 6. If the speed or deceleration of the elevator car 1 differs from the deceleration profile 3*a*, 3*b* by more than the threshold value recorded in memory, the safety controller 6 disconnects the safety signal 16, in which case the electricity supply to the electric motor of the hoisting machine 2 ceases, both machinery brakes 4 engage to brake the traction sheave 5, and the emergency stop continues to the end by means of the machinery brakes 4 without motor braking.

At the end of an emergency stop, when the speed of the traction sheave 5/elevator car 1 has decreased to below a certain threshold value, most preferably to below 0.2 m/s, the safety controller 6 brings the elevator to a safe state by disconnecting the safety signal 16. In this case the electricity supply to the electric motor of the hoisting machine 2 ceases and the machinery brakes 4 engage to brake the traction sheave 5.

In some further developed embodiments the operating voltage of the safety controller 6 as well as of the rest of the safety circuit is backed up with a battery as a precaution against an electricity outage. In addition, the operating voltage to the microprocessors of the frequency converter 9 and to the other control circuits is arranged from the intermediate circuit of the frequency converter, in which case the braking energy of the electric motor of the hoisting machine 2 can be utilized in the operating voltage of the aforementioned microprocessors/control circuits. This means that emergency braking according to the description with the electric motor of the hoisting machine 2 is possible also during an electricity outage that occurs in the electricity network 23.

In some further developed embodiments the software of the frequency converter 9 is configured to start an emergency stop process according to the description in certain cases independently, without a command being received separately from the safety controller 6. Consequently the frequency converter 9 can comprise overspeed monitoring as well as undervoltage monitoring, in which case the frequency converter 9 can start an emergency stop e.g. as a consequence of overspeed of the traction sheave 5 or elevator car 1 or as a consequence of acceleration or deceleration of the traction sheave 5 or elevator car 1 that differs from the normal, or, on the other hand, also as a consequence of an electricity outage that has occurred in the electricity network 23.

In FIG. 1 the frequency converter 9 as well as the contactors 17 in the main circuit of the machinery brakes 4 are controlled with the safety signal 16. The control could also be implemented in other ways; the safety signal 16 could be e.g. connected to control electronics of the frequency converter 9 and also of the brake control circuit 18 in such a way that when disconnecting the safety signal 16 the passage of control pulses to the IGBT transistors of the frequency converter 9 as well as to the MOSFET transistors of the brake control circuit 18 ceases, in which case also the electricity supply to the electric motor of the hoisting machine 2 ceases and both machinery brakes 4 engage to brake the traction sheave 5.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A method for performing an emergency stop with an elevator, said method comprising the steps of:

when an emergency stop criterion is fulfilled, driving the elevator car with an electric motor of a hoisting machine to a stop with a given deceleration profile;

forming at least two deceleration profiles with different maximum decelerations; and selecting the deceleration profile to be used from the at least two deceleration profiles on the basis of the state of the safety circuit of the elevator.

2. The method according to claim 1, further comprising the step of connecting a machinery brake to brake the traction sheave of the hoisting machine of the elevator at the same time as the elevator car is driven with the electric motor of the hoisting machine to a stop.

3. The method according to claim 1, further comprising the step of measuring the movement of the elevator car during an emergency stop.

4. The method according to claim 2, further comprising the steps of:

measuring the deceleration of the traction sheave;

if the deceleration of the traction sheave is excessive, driving against the brake with the electric motor in such a way that the deceleration of the traction sheave remains according to the given deceleration profile.

5. The method according to claim 3, further comprising the steps of:

determining a threshold value for limiting the permitted movement of the elevator car;

connecting a second machinery brake to brake the traction sheave of the hoisting machine of the elevator; and disconnecting a power supply to the electric motor of the hoisting machine of the elevator, if a movement of the elevator car during an emergency stop differs from the permitted movement by more than the threshold value.

6. The method according to claim 1, further comprising the steps of:

monitoring the slipping of the hoisting roping on the traction sheave during an emergency stop;

if the magnitude of the slipping exceeds the threshold value, reducing the deceleration of the elevator car in the deceleration profile.

7. The method according to claim 1, wherein the emergency stop criterion is one or more of the following:

an electricity outage;

the opening of a safety contact of the elevator;

overspeed of the elevator car; and excessive acceleration or deceleration of the elevator car.

8. A safety arrangement of an elevator, comprising:

an elevator car;

hoisting roping of the elevator car;

a hoisting machine, comprising an electric motor and a traction sheave, via which the hoisting roping of the elevator car travels;

a controller, configured to regulate the movement of the elevator car by supplying current to the electric motor of the hoisting machine; and a monitoring unit configured to determine the operating state of the elevator and to compare the determined operating state to one or more emergency stop criteria, the monitoring unit being configured, when one or more emergency stop criteria are fulfilled, to form an emergency stop command for the controller, wherein the emergency stop command comprises a specification of the state of the safety circuit wherein the controller comprises a processor for forming a deceleration profile, wherein the controller is configured to form at least two deceleration profiles with different maximum decelerations, wherein the controller is configured to select from the deceleration profiles the deceleration profile to be used during the emergency stop on the basis of the emergency stop command, and wherein the controller is configured to drive the elevator car with the electric motor of the hoisting machine to a stop with a deceleration profile to be formed in response to an emergency stop command.

9. The safety arrangement according to claim 8, wherein the hoisting machine comprises at least two machinery brakes for braking the traction sheave of the hoisting machine, and wherein the controller is configured to connect only one of the machinery brakes to brake the traction sheave of the hoisting machine of the elevator at the same time as the elevator car is driven with the electric motor of the hoisting machine to a stop.

10. The safety arrangement according to claim 8, wherein the controller is configured to determine the deceleration of the elevator car.

11. The safety arrangement according to claim 10, wherein the controller is configured to connect a machinery brake to brake the traction sheave of the hoisting machine of the elevator at the same time as the elevator car is driven with the electric motor of the hoisting machine to a stop, if the deceleration of the elevator car during the emergency stop falls below the threshold value.

12. The safety arrangement according to claim 8, wherein the monitoring unit is configured to determine the speed of the elevator car and to connect a machinery brake and to disconnect the power supply to the electric motor of the hoisting machine of the elevator when the speed of the elevator car during the emergency stop falls below the threshold value.

13. The safety arrangement according to claim 8, wherein the controller is configured:

to determine the deceleration of the traction sheave; and to drive with the electric motor against the brake in such a way that the deceleration of the traction sheave remains according to the given deceleration profile, if the determined deceleration of the traction sheave is excessive.

14. The safety arrangement according to claim 9, wherein a threshold value for limiting the permitted movement of the elevator car is recorded in the memory of the monitoring unit, and;

wherein the monitoring unit is configured to connect a second machinery brake to brake the traction sheave of the hoisting machine of the elevator and to disconnect the power supply to the electric motor of the hoisting machine of the elevator, if a movement of the elevator car during an emergency stop differs from the permitted movement by more than the threshold value.

15. The safety arrangement according to claim 8, wherein an emergency stop criterion is one or more of the following:

an electricity outage;

the opening of a safety contact of the elevator;

overspeed of the elevator car; and excessive acceleration or deceleration of the elevator car.

16. The method according to claim 2, further comprising the step of measuring the movement of the elevator car during an emergency stop.

17. The method according to claim 3, further comprising the steps of:

measuring the deceleration of the traction sheave; and if the deceleration of the traction sheave is excessive, driving against the brake with the electric motor in such a way that the deceleration of the traction sheave remains according to the given deceleration profile.

18. The method according to claim 4, further comprising the steps of:

determining a threshold value for limiting the permitted movement of the elevator car;

connecting a second machinery brake to brake the traction sheave of the hoisting machine of the elevator; and disconnecting the power supply to the electric motor of the hoisting machine of the elevator, if a movement of the elevator car during an emergency stop differs from the permitted movement by more than the threshold value.

19. The method according to claim 2, further comprising the steps of:

monitoring the slipping of the hoisting roping on the traction sheave during an emergency stop; and if the magnitude of the slipping exceeds the threshold value, reducing the deceleration of the elevator car in the deceleration profile.

20. The method according to claim 3, further comprising the steps of:

monitoring the slipping of the hoisting roping on the traction sheave during an emergency stop; and if the magnitude of the slipping exceeds the threshold value, reducing the deceleration of the elevator car in the deceleration profile.

* * * * *